US006244086B1

(12) United States Patent
Hopf et al.

(10) Patent No.: US 6,244,086 B1
(45) Date of Patent: Jun. 12, 2001

(54) HAND TOOL ALIGNMENT DEVICE AND METHOD

(75) Inventors: Steven L. Hopf; James Scheltens, both of Riverside, CA (US)

(73) Assignee: Ultra Dent Tools, Riverside, CA (US)

( * ) Notice: Subject to any disclaimer, the term of this patent is extended or adjusted under 35 U.S.C. 154(b) by 0 days.

(21) Appl. No.: 09/503,993

(22) Filed: Feb. 14, 2000

(51) Int. Cl.[7] ..... B21C 51/00
(52) U.S. Cl. ..... 72/37; 72/458; 72/705
(58) Field of Search ..... 72/705, 37, 457, 72/458; 901/23, 25

(56) References Cited

U.S. PATENT DOCUMENTS

| | | | | |
|---|---|---|---|---|
| D. 349,906 | | 8/1994 | Galbraith et al. | D15/142 |
| 3,117,480 | | 1/1964 | Peddinghaus | 83/520 |
| 3,130,633 | | 4/1964 | Rantsch | 88/24 |
| 3,728,027 | | 4/1973 | Watanabe | 356/13 |
| 4,447,139 | * | 5/1984 | Biber | 350/522 |
| 4,698,479 | * | 10/1987 | Rando et al. | 901/40 |
| 4,826,304 | * | 5/1989 | Guch, Jr. et al. | 350/618 |
| 5,479,804 | | 1/1996 | Cook | 72/35 |
| 5,616,141 | | 4/1997 | Cipolla | 606/15 |
| 5,634,537 | * | 6/1997 | Thorn | 188/300 |
| 5,740,699 | * | 4/1998 | Ballantyne et al. | 901/23 |

* cited by examiner

*Primary Examiner*—Ed Tolan

(57) ABSTRACT

An alignment device to assist a user in the functional application of a hand tool. The hand tool can take a variety of forms but is preferably a dent removal tool. The alignment device is preferably retrofitable onto existing hand tools by use of a base bracket that mounts onto the handle or shank of the tool. A sight device is mounted on the device and includes a multiple degree of freedom joint. This joint allows the user to easily and quickly align the sight device to locate the work piece. The work piece can then be placed in a desired position even positioned such that it is obscured from the sight of the user. Positioning the work piece of a dent removal tool behind the opaque surface of dented sheet metal structure is a typical application. The alignment device allows the user to quickly and accurately position the work piece, behind the surface, thereby increasing the efficiency of the user.

23 Claims, 4 Drawing Sheets

HAND TOOL ALIGNMENT DEVICE AND METHOD

BACKGROUND OF THE INVENTION

The invention herein relates to an alignment device for a hand tool and more particularly to sight specific alignment attachment for paintless dent removal tools and method of using same.

Hand tools come in a variety of forms to meet a vast array of functions. In many cases particular tools are used in such a method that the user's line of sight is obstructed by a structure. Typically the user learns from trial and error in order to locate the work piece of the tool in the proper position. Auto body dent removal tools are a prime example of this intended use. The work piece of the tool is usually extended behind the dented sheet metal. This process is necessary for the tool to be placed on the dent. In doing so the tool is now obstructed from view by the sheet metal. A quick, easy and reliable method of locating the work piece of the tool would be greatly beneficial due to increased efficiency of the user. Unfortunately, few attempts have been made to provide a practical solution to this common problem.

SUMMARY OF THE INVENTION

Present Invention

In one aspect, the invention features a hand tool alignment device that includes a base bracket that enables releasable mounting to a hand tool. The base bracket also supports a substantially longitudinal frame, the frame includes a joint that has at least three degrees of freedom. A sight device is attached to the frame. When the combination is secured to a hand tool by the base bracket, the sight device can be positioned by the joint, such that the sight device locates a position on the hand tool.

The system may also include the capability to be retrofitable on a hand tool. Here the base bracket enables releasably secure mounting to the hand tool. A substantially longitudinal frame, includes at least two movable joints, the frame being mounted to the base bracket. A sight device is attached to the frame.

In another aspect, the invention includes a method of locating a work piece that is visually obstructed by an opaque surface utilizing the afore mentioned system of a sight device that is attached to a frame including a joint that is capable of movement of at least three degrees of freedom. By positioning the work piece on one side of an opaque surface with said sight device on a second side thereof, the sight device identifies the position of said work piece to the user.

Definition of Terms

Unless otherwise defined, all technical and scientific terms used herein have the same intended meaning as would be commonly understood by anyone of ordinary skill in the art to which this invention belongs. To eliminate possible ambiguity, specific terms used herein have been defined as they would be applied to the present invention.

A "work piece" is the portion of a tool that is used in intimate contact with the desired object of the function of the tool. The twelve point ring, that constitutes the area of contact between a wrench and the head of a fastener, would be considered the work piece of a box end wrench. Similarly, the term can be used to describe the socket of a ratchet wrench and the contact tip of a dent removal tool.

A "coherent light" is a light that has a pattern or tends to remain united. Such is the case with a laser light.

A "laser light" includes all forms of light energy generated by amplification by the stimulated emission of radiation. For the purpose of this disclosure, this includes any coherent light including light generated from the use of a ruby laser, a gas laser, dye lasers and semiconductor lasers.

DETAILED DESCRIPTION OF THE PREFERRED EMBODIMENT

The object of the disclosed invention is to provide an improved alignment device for use with hand tools, especially for use with dent removal tools. In the preferred embodiment, the device includes a base bracket that can be releasably mounted to a hand tool. The ease of release and mounting is desirable in that the device can be retrofitable onto a wide variety of hand tools, quickly and easily. From the base bracket extends a longitudinal frame, which preferably includes a linear adjustment. On the distal end of the longitudinal frame is a sight device, preferably a laser, that is connected to the frame by joint. In the preferred embodiment this joint is a spherical joint, thereby enabling movement of three degrees of freedom.

Figure 1:
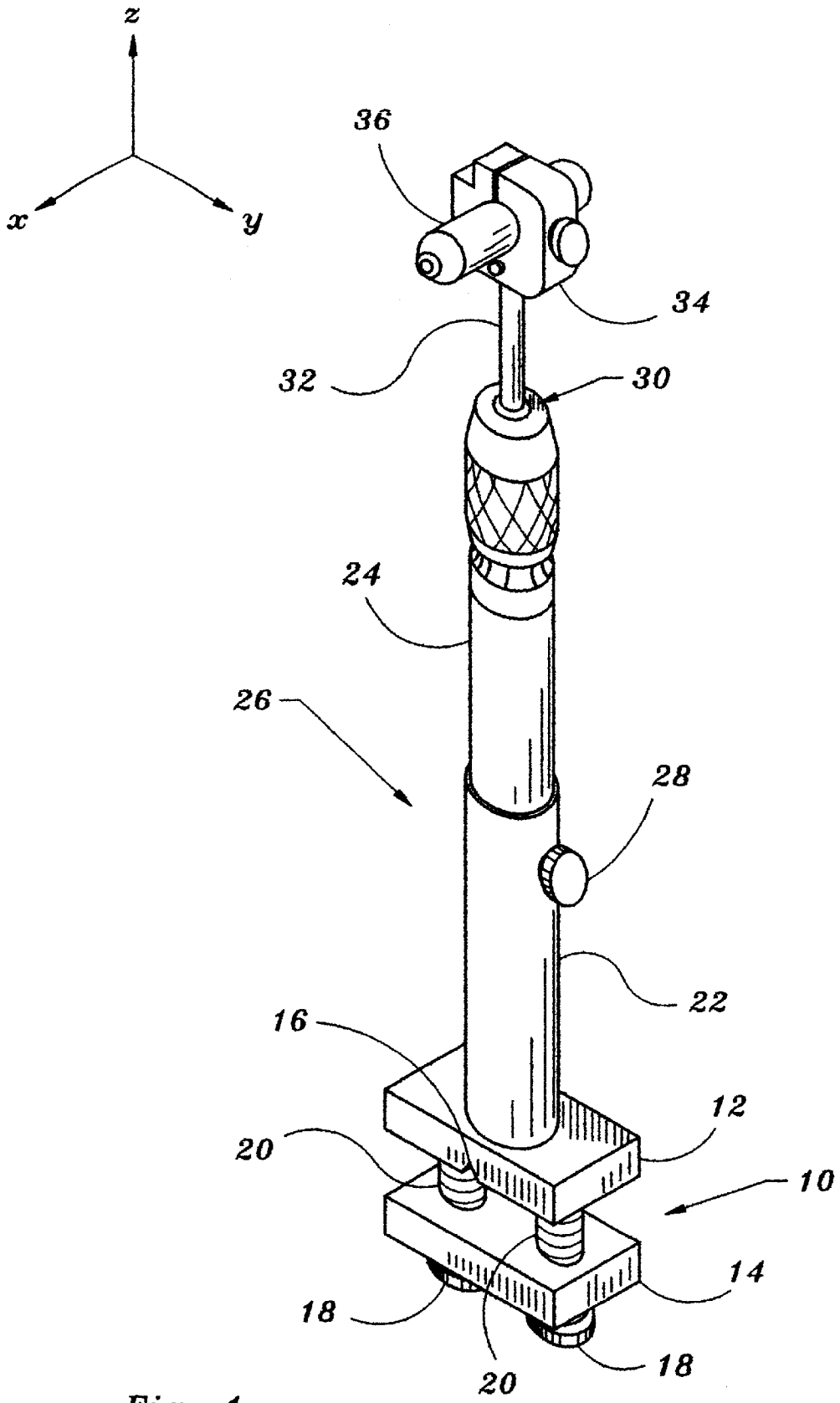
FIG. 1 is an isometric view of a hand tool alignment device, the device produced in accordance with the preferred embodiment of the present invention.

An isometric view of a preferred embodiment of the device is shown in FIG. 1. Here the base bracket 10 is shown as with an upper 12 and a lower 14 portion. A notch 16 is included in the upper portion to aid in locating and stabilizing a cylindrical object, such as the handle of a hand tool. The lower portion 14 is actuated toward the upper portion 12 by turning nuts 18 which are received by the threaded rods 20. This combination enables the base bracket 10 to be releasably secured on a tool handle, with minimal time and effort while being infinitely adjustable within a range of handle diameters. This is one embodiment that has been used with great success by the applicant. Various other methods of attachment that are common in the art could also be used for this purpose.

Attached to the upper portion 12 is a base frame 22 which receives an extension frame 24. This combination comprises a longitudinal frame 26 that allows for linear adjustment. A lock knob 28 is threaded through the wall of the base frame, the tip of the lock knob 28 contacting the wall of the extension frame 24 thus securing it in place at a given length orientation within the range of the longitudinal frame 26.

The distal end of the extension frame 24 includes a spherical joint 30 attached to a mounting arm 32. The spherical joint 30 is preferable in that it enables movement in three degrees of freedom, rotation about the long axis of the mounting arm ("z" axis) and pivotal adjustment about both the "x" and "y" axes. At the distal end of the mounting arm 32 is a sight bracket 34 which is used to secure a laser sight device 36 to the end of the mounting arm 32.

The laser sight device 36 is preferably a laser semiconductor laser as is commonly used in the art in a variety of applications. Any form of coherent light producing device can be used. The general laser device as shown is compact, inexpensive and reliable, thought the applicant does not intend to limit the scope of the disclosure to any particular form of laser or specific sight device.

Figure 2:
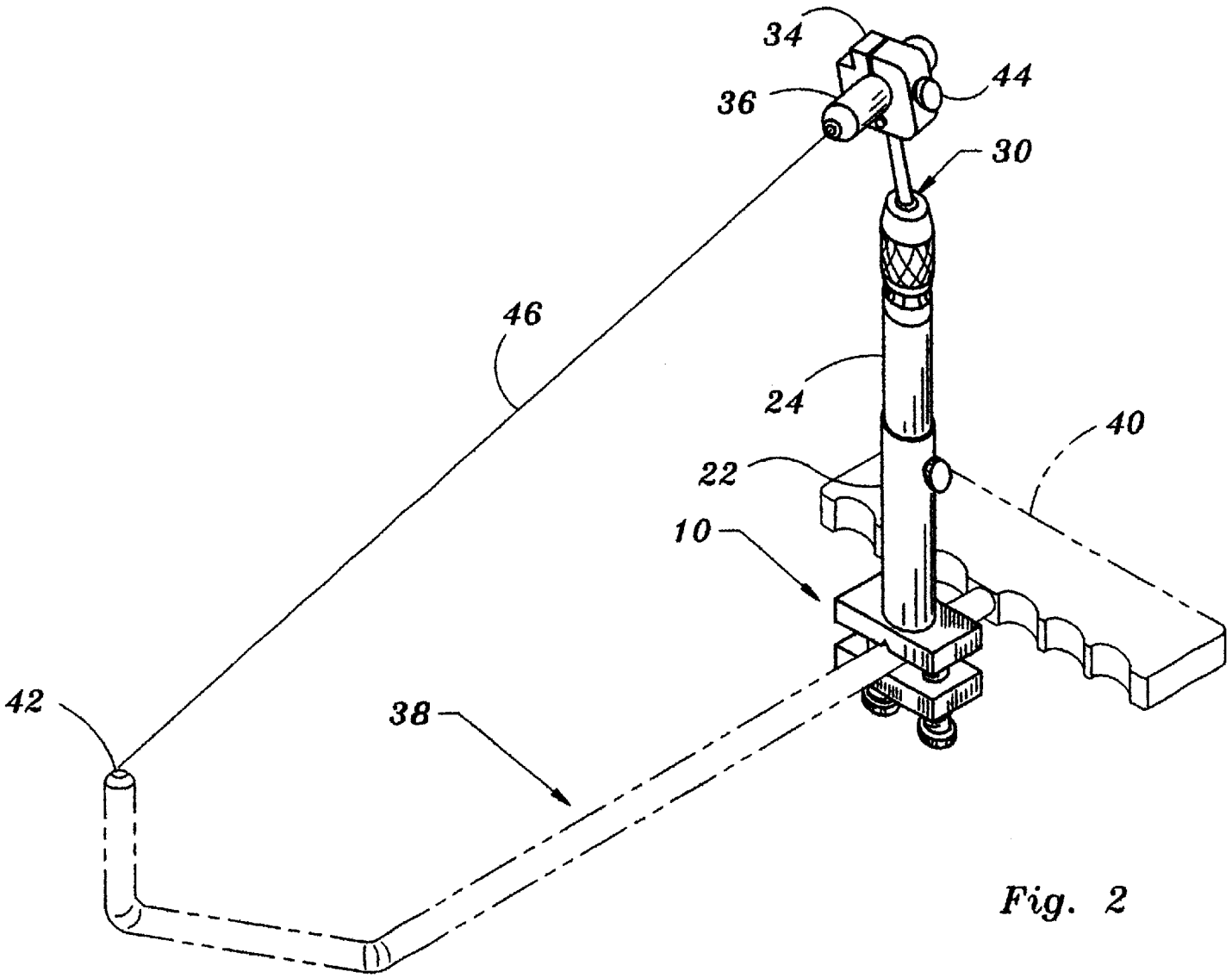
FIG. 2 is an isometric view of a hand tool alignment device shown as it would typically be used with a dent removal tool, the device produced in accordance with the preferred embodiment of the present invention.

The laser sight device 36 when secured to the sight bracket 34 enables a laser sight to be projected a particular point as can be determined by the linear adjustment of the extension frame 24 and the spherical joint 30. This is more ideally shown in FIG. 2. Here the base bracket 10 is secured to the shank of a dent removal tool 38. The extension frame 24 is extended from the base frame 22 to increase the height of the laser 36 from the tool 38. This may be desirable in that an object could be positioned between the handle 40 and the work piece 42 of the tool. The laser 36 is then turned on by depressing the button 44 which activates the laser light 46. The laser 36 optimally includes a timer which turns the laser off after several seconds. This allows the laser to used for a prolonged period of time on a single battery, thus making the laser 36 completely self contained and not requiring any form of tether for switches or an additional power supply. The laser 36 may also operate by a simple on/off switch, without a timer, the switch being directly controlled by the user.

The laser 36 and the sight bracket 34 are then moved by use of the spherical joint 30 to align the sight of the laser 36 to locate the work piece 42. The work piece 42 can then be positioned such that it is obstructed from the view of the user, the laser light 46 eliminating the position of the work piece to the user.

The user of a laser or other coherent light has been determined to be preferable but other sight devices could also be used in this application. Any sight device such as a scope or gun sight could be used. The user's line of sight would function as the laser light of that previously disclosed. The laser is preferable in that the user can observe the location of the work piece from any perspective, disregarding the orientation of the tool with respect to the user.

Figure 3:
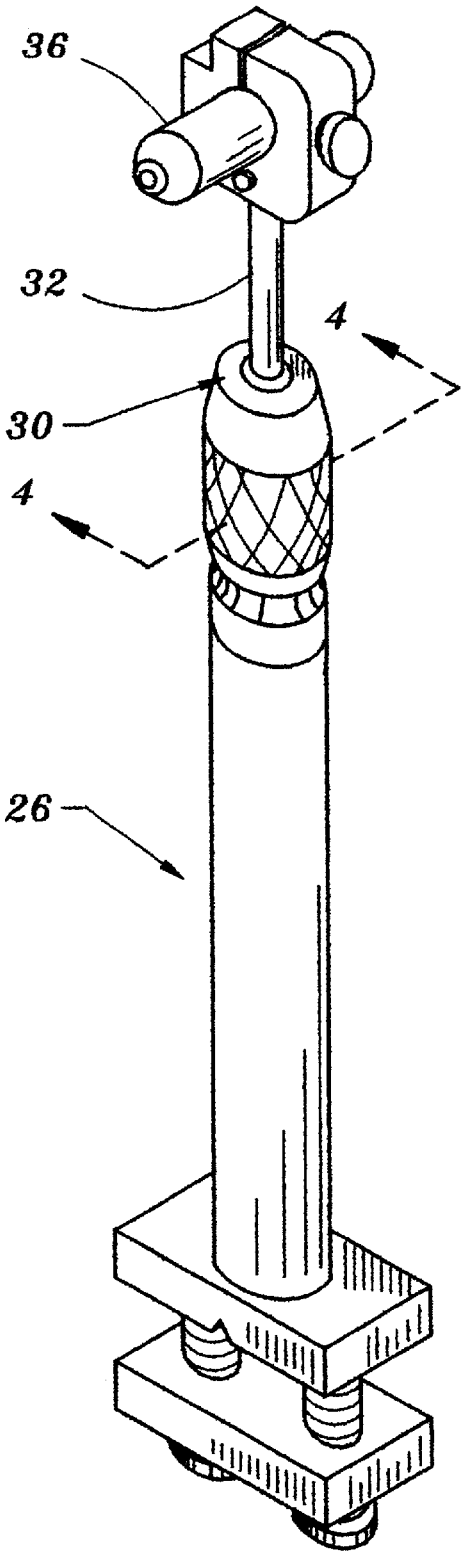
FIG. 3 is an isometric view of a hand tool alignment device without a linear adjustment, the device produced in accordance with an alternative preferred embodiment of the present invention.

An alternative to the preferred embodiment is shown in FIG. 3. Here the linear adjustment has been eliminated. Since the laser 36 which is supported by the mounting arm 32 which is connected to the longitudinal frame 26 by use of the spherical joint 30, the laser 36 is able to move with three degrees of freedom and therefore in many cases has adequate adjustment. The use of any pivoting joint (shown here as the spherical joint 30) is best used in this application with a friction lock. A friction lock includes any mechanism that enables the joint to be adjusted, friction then securing the joint in that position. This eliminates the need for other screw knobs, locking pins and the such to hold the laser 36 in the desired position. In addition, since the joint 30 is articulated only by overcoming the friction of the locking system, the user can move the joint 30 into position and secure it with one hand. This is desirable in an application such as this where likely one hand is used to support the hand tool and the free hand can then articulate the joint 30, aiming the laser 36.

Figure 4:
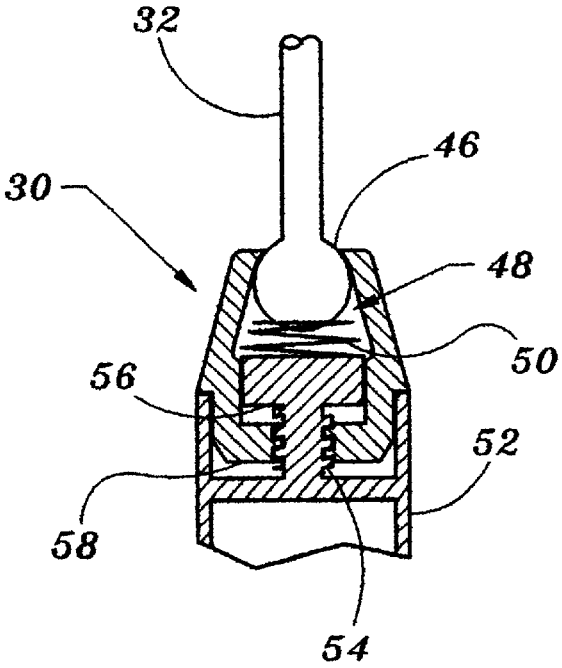
FIG. 4 is a partial front sectioned view along the line 4—4 shown in FIG. 3 of a version of the internal portion of spherical joint and friction lock, the device produced in accordance with the preferred embodiment of the present invention.

An example of a spherical joint 30 with a friction lock taken along line 4—4 of FIG. 3 is shown in FIG. 4. Here the mounting arm 32 is shown as connected to a ball 46. The ball, or sphere is received by the socket 48. A biasing device, shown here as a coil spring 50 is used to offer a force application of the upper portion of the ball 46 against the upper portion of the socket 48. This contact results in a frictional force between the ball 46 and the socket 48, thus opposing movement of one with respect to the other. An adjustment is shown in this sectioned view in that the sleeve 52 is connected to a threaded portion 54 which is connected to the platform 56, which in turn supports the spring 50. The threaded portion 54 is received by a nut 58, whereby rotation of the sleeve 52 results in increasing or decreasing the tension in the spring 50. This variance in spring tension directly alters the normal force the ball 46 places on the upper portion of the socket 48, thus varying the frictional force. This is only one example of a friction lock that could be used in this application and as such is not intended to be limiting to the scope of the application.

Figure 5:
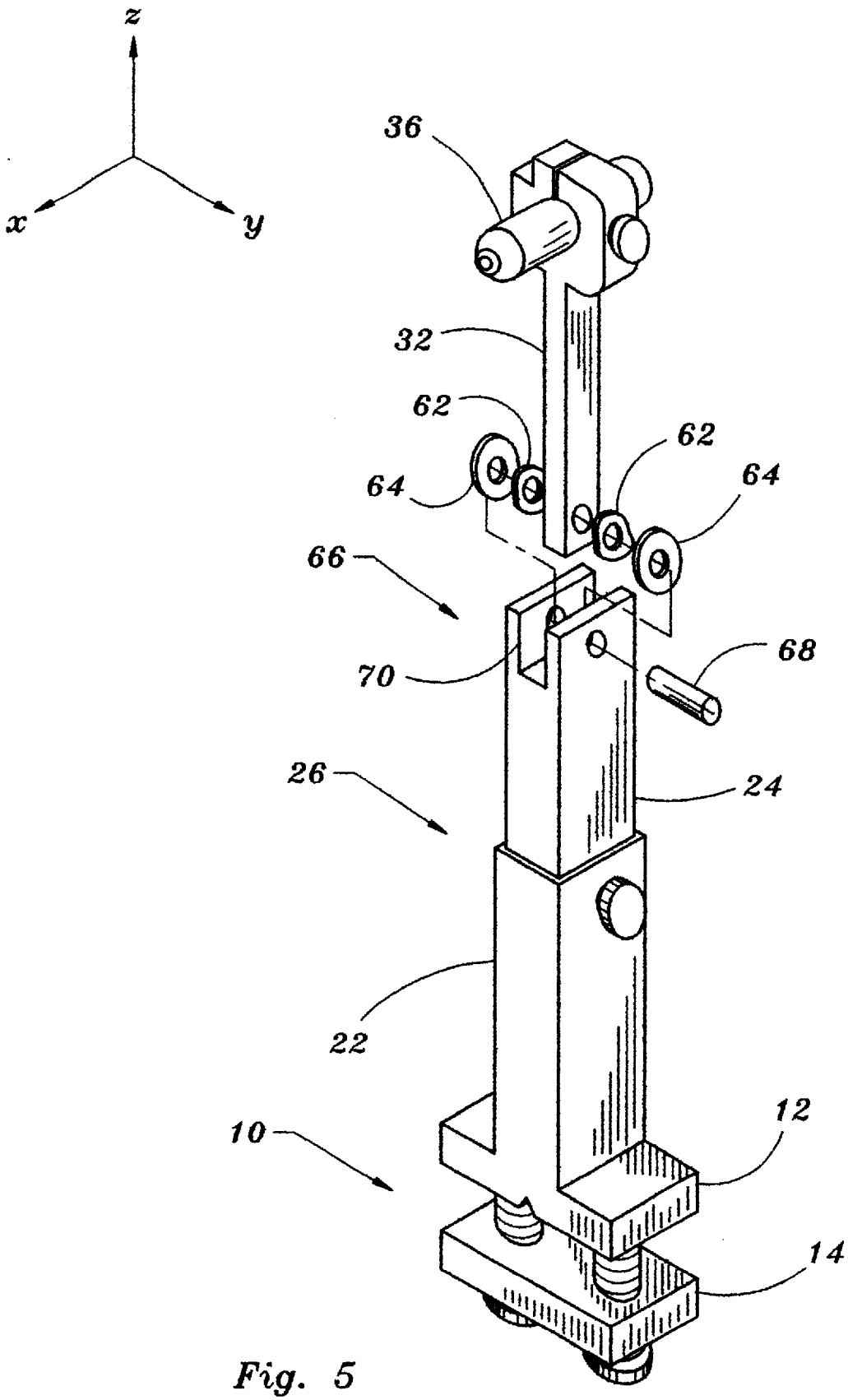
FIG. 5 is an isometric exploded view of a hand tool alignment device with linear and pivotal adjustments, the device produced in accordance with an alternative preferred embodiment of the present invention.

An alternative to the preferred embodiment is shown in FIG. 5. A base bracket 10 with an upper portion 12 and a lower portion 14 are included and used as previously disclosed. The longitudinal frame 26 is here shown to be constructed of a square material as opposed to a round material as previously suggested. In all applications either type of construction is acceptable and one or the other may be desirable in specific instances. The base frame 22 received the extension frame 24, providing a linear adjustment. In many cases the work piece of the tool is in alignment with the handle of the tool. In this case adjustments along the longitudinal axis ("z" axis) of the device is not necessary. In this instance the use of the spherical joint can be replaced with a pivoting joint 60.

The desire for a friction lock is again apparent, for the "ease of operation" feature as previously noted. One example of such a lock is shown here which includes a pair of spring washers 62 which contact the mounting arm 32 on one side and a pair of thrust washers 64 on the other side. The combination is pivotally mounted to a clevis mount 66 by a pin 68 near the distal end of the extension frame 24. The spring washers 62 apply a load against the thrust washers 64 which in turn generate a frictional force against the inside walls 70 of the clevis mount 66. This enables the laser 36 to be adjusted in angular orientation to align the laser 36 with any work piece that the device may be attached to, the frictional force generated securing it in place while the device is in use.

As previously noted this is but one example of the numerous variations that would function under the intended scope of the disclosed invention. As such, specifics of the disclosed are not intended to be limiting.

What is claimed is:

1. An automobile dent removal tool alignment device for locating a visually obstructed workpiece comprising:

a base bracket enabling releasably secure mounting to a hand tool;

a substantially longitudinal frame comprising a base frame, an extension frame being moveably secured one to another and a joint enabling at least three degrees of freedom, said substantially longitudinal frame mounted to said base bracket; and a sight device attached to said substantially longitudinal frame on a distal end opposite to said base bracket.

2. The alignment device as described in claim 1, wherein said sight device is comprised of a visual scope.

3. The alignment device as described in claim 1, wherein said sight device is comprised of a light source.

4. The alignment device as described in claim 3, wherein said light source is comprised of a type that emits a coherent light.

5. The alignment device as described in claim 3, wherein said light source is comprised of a laser light.

6. The alignment device as described in claim 1, wherein said joint providing at least three degrees of freedom is comprised of a spherical joint.

7. The alignment device as described in claim 6, wherein said spherical joint includes a friction lock, the joint being comprised of a spherical portion received by a concave portion and a spring enabling frictional contact between said spherical portion and said concave portion.

8. The alignment device as described in claim 1, wherein said hand tool is a dent removal tool.

9. A retrofitable automobile dent removal tool alignment device for locating a visually obstructed workpiece comprising:

a base bracket enabling releasably secure mounting to a hand tool;

a substantially longitudinal frame, including a linearly movable joint and a pivoting joint, which includes a friction lock, said frame mounted to said base bracket;

a mounting arm adapted to receive said pivoting joint; and a sight device received by said mounting arm.

10. The retrofitable alignment device as described in claim 9, wherein said sight device is comprised of a visual scope.

11. The retrofitable alignment device as described in claim 9, wherein said sight device is comprised of a light source.

12. The retrofitable alignment device as described in claim 11, wherein said light source is comprised of a type that emits a coherent light.

13. The retrofitable alignment device as described in claim 11, wherein said light source is comprised of a laser light.

14. The retrofitable alignment device as described in claim 9, wherein said hand tool is a dent removal tool.

15. An automobile dent removal tool alignment device for locating a visually obstructed workpiece comprising:

a base bracket that enables releasable mounting to a hand tool and supports a substantially longitudinal frame, the frame comprising a base frame, an extension frame being moveably secured one to another and a joint enabling at least three degrees of freedom; and a sight means attached to said substantially longitudinal frame on a distal end opposite to said base bracket.

16. The alignment device as described in claim 15, wherein said sight means is comprised of a visual scope.

17. The alignment device as described in claim 15, wherein said sight means is comprised of a light source.

18. The alignment device as described in claim 17, wherein said light source is comprised of a type that emits a coherent light.

19. The alignment device as described in claim 17, wherein said light source is comprised of a laser light.

20. The alignment device as described in claim 15, wherein said joint providing at least three degrees of freedom is comprised of a spherical joint.

21. The alignment device as described in claim 20, wherein said spherical joint includes a friction lock, the joint being comprised of a spherical portion received by a concave portion and a spring enabling frictional contact between said spherical portion and said concave portion.

22. The alignment device as described in claim 15, wherein said hand tool is a dent removal tool.

23. A method for locating a work piece that is visually obstructed by an opaque surface, comprising:

providing a hand tool having a work piece located thereon;

providing an alignment device that includes:

a base bracket that mounts to said hand tool and supports a substantially longitudinal frame comprising a base frame, an extension frame being moveably secured one to another and a joint enabling at least three degrees of freedom; and a sight device attached to said substantially longitudinal frame on a distal end opposite to said base bracket;

adjusting said alignment device such that said sight device locates said work piece; and positioning said work piece on one side of an opaque surface with said sight device on a second side thereof, whereby said sight device identifies the position of said work piece to a user.

* * * * *